United States Patent [19]

Inaba

[11] 4,311,111

[45] Jan. 19, 1982

[54] APPARATUS FOR PAINTING A MULTIPLICITY OF PARTS TOGETHER

[75] Inventor: Toshimitsu Inaba, Kurobe, Japan

[73] Assignee: Kogyo K. K. Yoshida, Tokyo, Japan

[21] Appl. No.: 105,496

[22] Filed: Dec. 20, 1979

[30] Foreign Application Priority Data

Dec. 27, 1978 [JP] Japan ..... 53-164914

[51] Int. Cl.[3] ..... B05C 11/02; B05C 7/02

[52] U.S. Cl. ..... 118/56; 118/58; 118/69; 118/303; 118/418; 427/242; 427/374.1; 427/424; 427/425

[58] Field of Search ..... 427/242, 374.1, 424, 427/425; 118/56, 58, 66, 69, 303, 19, 20, 24, 418, 423

[56] References Cited

U.S. PATENT DOCUMENTS

| | | | |
|---|---|---|---|
| 1,973,778 | 9/1934 | Price | 118/69 X |
| 2,464,294 | 3/1949 | Cortese | 118/69 X |
| 2,821,157 | 1/1958 | Boyd | 118/708 |
| 3,141,792 | 7/1964 | Lachman et al. | 118/303 X |
| 3,384,048 | 5/1968 | Kutcher | 118/426 X |
| 3,394,677 | 7/1968 | Taylor et al. | 118/19 X |
| 3,601,087 | 8/1971 | Pearson | 118/56 |
| 3,607,712 | 9/1971 | Barton | 118/418 X |
| 4,098,225 | 7/1978 | Norman | 118/303 X |
| 4,098,932 | 7/1978 | Frische | 427/374.1 |

*Primary Examiner*—Shrive P. Beck

*Attorney, Agent, or Firm*—Hill, Van Santen, Steadman, Chiara & Simpson

[57] ABSTRACT

A batch of parts to be painted is put into each of a plurality of barrels rotatably mounted on an indexing turntable in angularly spaced relation therearound. A spray gun, a hot-air blower, and a cool-air blower are disposed in angularly spaced positions around the turntable respectively for spraying paint onto, heating, and cooling the parts in the barrels while the turntable is held at temporary rest between its intermittent angular movements. The sequence of the steps is repeated until the paint coating on the parts has a desired thickness thereon. A parts separator may be provided for separating the parts from each other to avoid possible paint adhesion therebetween.

13 Claims, 7 Drawing Figures

APPARATUS FOR PAINTING A MULTIPLICITY OF PARTS TOGETHER

BACKGROUND OF THE INVENTION

Field of the Invention

The present invention relates to an apparatus for painting a multiplicity of parts together.

SUMMARY OF THE INVENTION

According to the present invention, a batch of parts is put into a barrel, which is then rotated, and paint is sprayed onto the parts in the barrel being rotated. The coated paint on the parts is baked and then cooled. A sequence of such steps is repeated until the coating of paint on the parts has a desired thickness. A painting apparatus of the invention includes a plurality of barrels of wire mesh rotatably mounted on an indexing turntable for receiving respective batches of parts to be painted. A spray nozzle, hot-air blower, and a cool-air blower are disposed in angularly spaced relation around the turntable respectively for successive spray-painting, baking and cooling of the parts. Means may be provided for separating the parts from each other between the cooling and the spray-painting of the parts to avoid possible paint adhesion between the parts.

It is an object of the present invention to provide an apparatus for painting a multiplicity of parts together at an increased degree of rate of production.

Another object of the present invention is to provide an apparatus for coating a multiplicity of parts with a glossy, even layer of paint.

Still another object of the present invention is to provide means for separating painted parts from each other to protect against paint adhesion.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
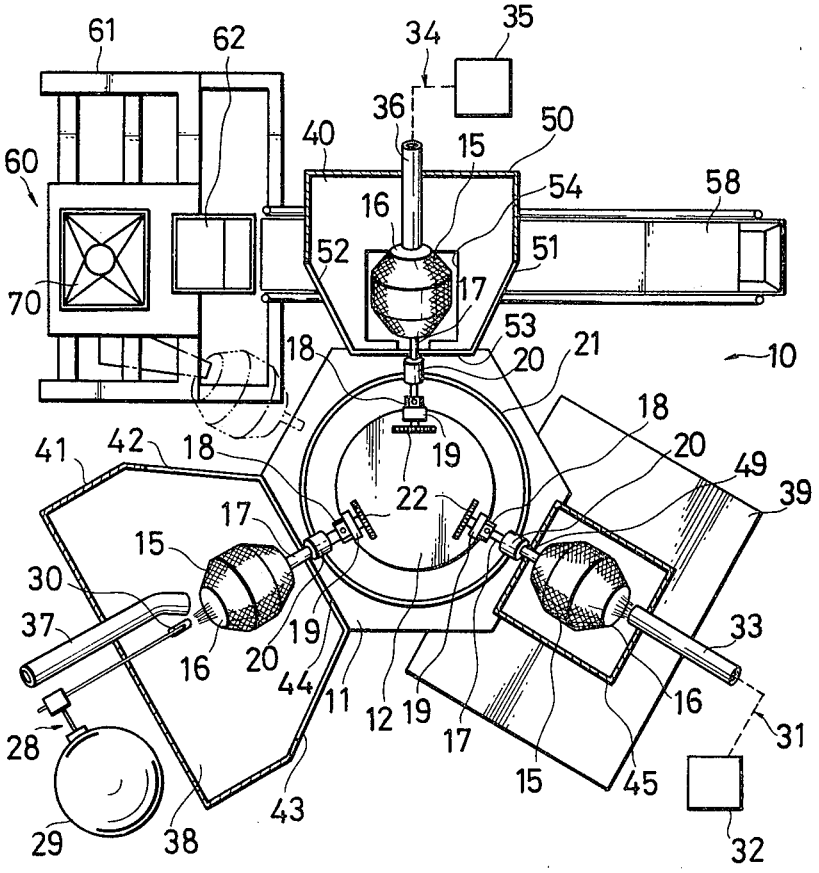
FIG. 1 is a plan view, partly cut away, of a painting apparatus according to the present invention.
Figure 2:
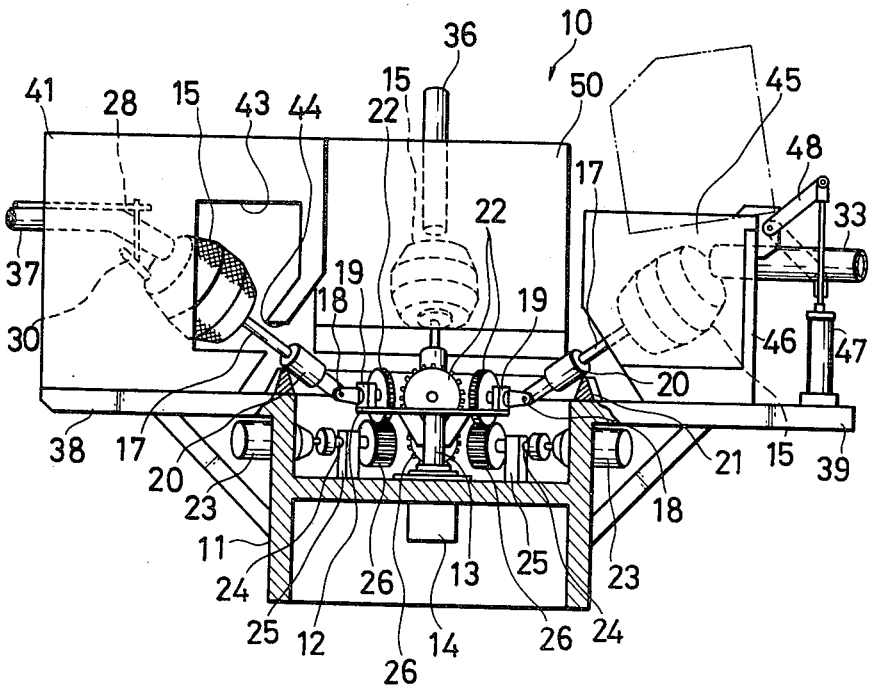
FIG. 2 is a front elevational view, partly cut away, of the painting apparatus shown in FIG. 1.

The principles of the present invention are particularly useful when embodied in a painting apparatus such as shown in FIGS. 1 and 2, generally indicated by the numeral 10.

The painting apparatus 10 comprises a frame 11, and a substantially horizontal indexing turntable 12 rotatably mounted on the frame 11 by a vertical drive shaft 13 coupled with a stepper motor 14 supported on the frame 11. A plurality of barrels 15 of wire mesh, each having a radially outwardly opening end 16, are rotatably mounted on the turntable 12 by a plurality of corresponding shafts 17 each connected concentrically to the other end of one of the barrels 15 and including a universal joint 18. Each of the shafts 17 is journaled in a bearing 19 on the turntable 12. The barrels 15 are located in angularly spaced relation around the turntable 12 and are inclined upwardly with a large-diameter portion 20 on each shaft 17 rollingly riding on an annular land or rail 21 disposed on the frame 11 in surrounding relation to the turntable 12.

The shafts 17 are connected at ends projecting beyond the bearings 19 to a plurality of respective driven gears 22 each having a portion disposed downwardly of the turntable 12. A plurality of angularly spaced motors 23 is supported on the frame 11 and the motors 23 are connected to a plurality of horizontal shafts 24, respectively, each journaled in a bearing 25 on the frame 11 and having a drive gear 26 positionable in driving mesh with one of the gears 22.

When the stepper motor 14 is energized, the indexing turntable 12 rotates intermittently to cause the barrels 15 to angularly move with the turntable 12. The barrels 15 are rotated in response to the meshing of the gears 22 with the gears 26 which are rotated while the turntable 12 is at rest between its intermittent movements.

A spray gun 28 comprises a tank 29 of paint and a spray nozzle 30 connected with the tank 29 and directed toward the open end 16 of one of the barrels 15 which is rotating but is held in one of the angular positions of the turntable 12. The spray nozzle 30 sprays an atomized mist of paint into such one of the barrels 15 to spray-deposit the paint on the parts in the barrel 15. A blower pipe 37 located adjacent to the spray gun 28 is also directed toward the barrel open end 16 for blowing air into the barrel 15 to set the coated paint on the parts.

A hot-air blower 31 is angularly spaced from the spray gun 28, and includes a compressor 32 with a heater and a blower pipe 33 coupled with the compressor 32 for directing hot air into another angularly spaced barrel 15 to bake the coated paint on the parts therein.

A cool-air blower 34 includes a compressor 35 and a blower pipe 36 coupled therewith for introducing cool air into still another barrel 15 that is held at rest while rotating.

A plurality of horizontal support wings 38,39,40 project radially outwardly from the frame 11 in angularly spaced positions corresponding respectively to the spray gun 28, the hot-air blower 31, and the cool-air blower 34. A box-like cover 41 is fixedly mounted on the support wing 38, and has a pair of openings 42,43 for the passage of the barrels 15 therethrough into and out of the cover 41 and a slot 44 extending between the openings 42,43 for allowing the shafts 17 to move therethrough.

The support wing 39 supports thereon a tiltable box-like cover 45 that is downwardly open and is pivotally coupled to a cover base 46 fixed to the wing 39. The cover 45 is pivotable upwardly by the actuation of a fluid actuator 47 through a link 48 connected between the cover 45 and the piston rod of the fluid actuator 47. When one of the barrels 15 is angularly moved until it is located under the cover 45 that is uplifted, the cover 45 is lowered to shield the barrel 15 for maximum utilization of heat and for protecting the operator against a possible burn that might otherwise result from the hot air blown into the barrel 15. The cover 45 has a vertical slot 49 receptive of the shaft 17 of the barrel 15 being covered.

Another box-like shield cover 50 is fixedly mounted on the support wing 40, and has a pair of openings 51,52 through which the barrels 15 can move into and out of the cover 50, and a slot 53 extending between the openings 51,52 for the passage therethrough of the barrel shafts 17.

Figure 5:
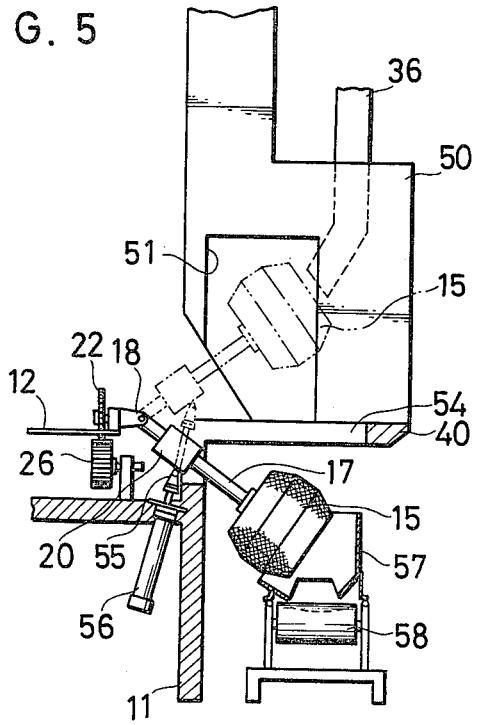
FIG. 5 is an elevational view of the portion of the painting apparatus from which the painted parts are discharged.

As best shown in FIG. 5, the wing 40 has a discharge opening 54 through which one of the barrels 15 at a time can move from the upwardly tilted position to a downwardly tilted position for discharging the painted parts out of the barrel 15. More specifically, the annular rail 21 includes a separated segmental portion 55 secured to the distal end of the piston rod of a fluid actuator 56 mounted on the frame 11, the portion 55 corresponding to the opening 54 in radial direction and being vertically retractable out of the rest of the annular rail 21. After the cooling of the parts in the barrel 15 in the cover 50 has finished, the fluid actuator 56 is actuated to retract the piston rod, and the segmental portion 55 is moved downwardly to allow the large-diameter shaft portion 20 resting thereon to be lowered until the barrel 15 is moved through the opening 54 to its downwardly tilted position. The parts in the barrel 15 are then thrown out through the open end 16 and a guide 57 onto a horizontal belt conveyor 58 for storage or additional processing such as parts separation as is described below.

In FIGS. 1 and 2, the parts to be spray-painted are loaded through the open end 16 into one of the barrels 15 that is empty in a position between the wings 40 and 38. The turntable 12 is angularly moved to bring the parts-loaded barrel 15 into the cover 41 and then is temporarily stopped for spray-painting operation. The barrel 15 is rotated by one of the motors 23 located below the wing 38 acting through the shaft 24, gear 26, gear 22, and shaft 17. Paint is sprayed from the spray nozzle 30 onto the parts in the barrel 15 being rotated, the amount of paint coated in one spraying operation being such that it will form a layer of paint on the parts which is much thinner than a finished layer having a desired thickness. Excessive paint that is discharged but not sprayed onto the parts will escape through the wire mesh of the barrel 15, thereby permitting the parts to be coated with an even layer of paint without irregular paint deposition thereon.

Upon spray deposition of paint on the parts, air is blown from the blower pipe 37 into the barrel 15 being rotated to set the coated paint on the parts.

The turntable 12 is again rotated stepwise until the barrel 15 with the paint-sprayed parts therein is positioned under the raised cover 45. The cover 45 is then lowered to cover the barrel 15, and hot-air is blown into the barrel 15 to heat the parts for baking the paint coating on the parts. After baking of the paint, the cover 45 is lifted and the turntable 12 is angularly moved again to place the barrel 15 containing the parts coated with the baked paint into the cover 50. Cool air is introduced from the pipe 36 into the barrel 15 to cool the baked paint on the parts.

The barrels 15, upon arrival at the paint-spraying, baking, and cooling stations, are automatically rotated by meshing engagement of the gears 22 with the motor-driven gears 26.

One cycle of operation of painting the parts together is thus completed. The sequence of the steps is repeated until the layer of coated paint on the parts has a desired thickness.

With this arrangement, the parts of a batch of parts are simultaneously painted. Furthermore, the parts will have a glossy, even coating of paint, and a possibility of the parts becoming stuck together due to paint adhesion is substantially eliminated.

To insure complete separation of the painted parts, a parts separator 60 (FIGS. 3 and 4) may be provided. The parts separator 60 comprises an upright framework 61 positioned at one end of the belt conveyor 58, and a vertically movable bucket 62 carried on a chain 63 trained around a pair of upper and lower sprockets 64,65 mounted on the framework 61. The bucket 62 has a pinion 66 rotatably attached by a pin 67 to a bracket 68 fixed to the chain 63. The framework 61 supports on its upper portion a vertical rack 69 positioned adjacent to the chain 63.

The parts separator 60 further comprises a hopper 70 adjacent to the rack 69, and a horizontally slidable selector 71 movable by a fluid actuator 59 and including a pair of downwardly diverging chutes 72,73. A hopper 74 is located downwardly of one of the chutes 72 and upwardly of a horizontal parts feeder 75 actuated by a vibrator 76. A vertical blower duct 77 extends downwardly from the parts feeder 75 and includes a plurality of nozzles 78 directed downwardly. A hopper 79 is disposed downwardly of the blower duct 77 and has a discharge opening 84 opening toward the bucket 62 at its lowermost position.

Figure 3:
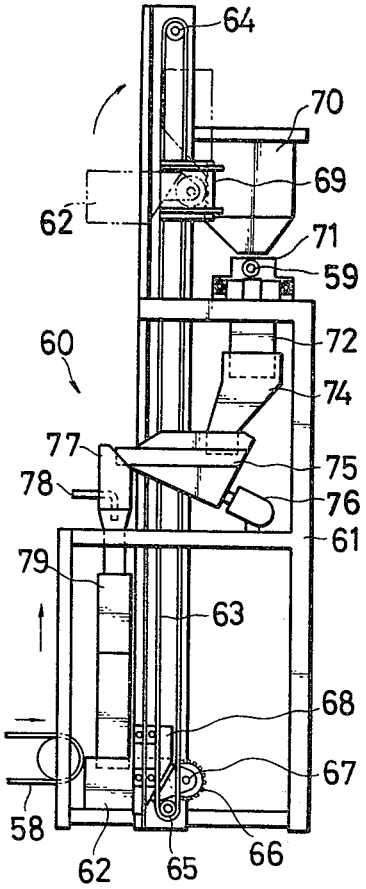
FIG. 3 is an end elevational view of a parts separator that is part of the painting apparatus.

A batch of parts 80 (FIG. 4) coated with paint in one of the barrels 15 is discharged from the barrel 15 onto the belt conveyor 58, which is driven in a direction opposite to that in which finished parts are transferred for storage or assembling. The parts 80 are thrown into the bucket 62, which is then moved upwardly by the chain 63. The upward movement of the bucket 62 causes the pinion 66 to mesh with the rack 69, whereby the bucket 62 is pivoted clockwise as shown in FIG. 3 to unload the parts 80 from the bucket 62 into the hopper 70. The parts 80 are discharged from the hopper 70 into the chute 72 with the selector 71 shifted in the position illustrated in FIG. 4. The chute 72 directs the parts 80 into the hopper 74 and then down the blower duct 77, in which the parts 80 are accelerated downwardly by air blown from the nozzles 78.

The parts 80 impinge on an inclined wall 85 of the hopper 79 that is located in the path of falling parts 80, and any parts 80 that may have adhered together are separated from each other upon impact. The parts 80 are discharged out of the opening 84 into the bucket 62, which is again moved upwardly in order to repeat the cycle of parts-separating operation until the parts 80 are separated completely.

Figure 4:
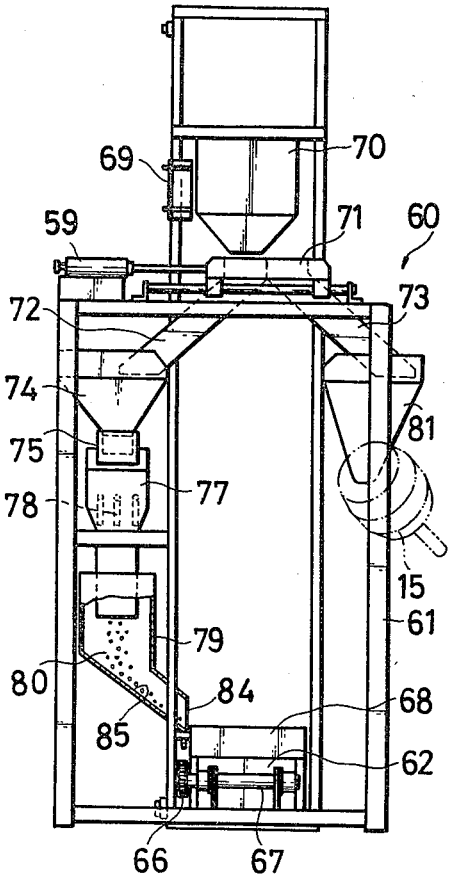
FIG. 4 is a side elevational view of the parts separator shown in FIG. 3.

Then, the selector 71 is slid by the actuator 59 to the left in FIG. 4 to allow the parts 80 to go from the hopper 70 down the chute 73 into a hopper 81 and thence into one of the barrels 15 that is held at temporary rest between the cooling and paint-spraying stations and is ready for another cycle of parts painting operation.

Figure 6:
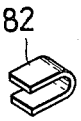
FIGS. 6 and 7 are enlarged perspective views of parts to be painted.
Figure 7:
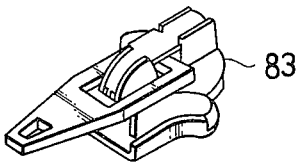

FIG. 6 shows an end stop 82 for slide fasteners, which is an example of the part 80. A slide fastener slider 83 illustrated in FIG. 7 represents another example that can be painted on the painting apparatus 10.

Although various minor modifications may be suggested by those in the art, it should be understood that I wish to embody within the scope of the patent warranted hereon, all such embodiments as reasonably and properly come within the scope of my contribution to the art.

I claim as my invention:

1. An apparatus for painting batches of parts, comprising:

(a) a frame having a stationary annular rail;

(b) a turntable rotatably mounted on said frame and concentrically surrounded by said annular rail;

(c) a plurality of angularly spaced barrels rotatably supported jointly by said rail and turntable and extending radially outwardly of said annular rail, each of said barrels being receptive of a batch of parts;

(d) first drive means on said frame for indexing said turntable to move said barrels successively to at least three separate angularly spaced stations disposed on said frame around said turntable;

(e) second drive means on said frame for rotating said barrels only in said angularly spaced stations; and (f) said angularly spaced stations including a paint spray nozzle, a hot-air blower, and a cool-air blower, respectively, directed toward said barrels.

2. An apparatus according to claim 1, said turntable and said rail being horizontal.

3. An apparatus according to claim 1, including a shaft having one end portion supported on said turntable, the opposite end being secured to one of said barrels, and an intermediate portion inclined upwardly and outwardly and being in rolling engagement with said rail.

4. An apparatus according to claim 3, the support for said one end portion being provided by a bearing on said turntable.

5. An apparatus according to claim 1, a segment of said rail being retractable to a lowered position for tilting a one of said barrels carried thereby to an emptying position.

6. An apparatus according to claim 1, said rail carrying said barrels at an upwardly outwardly inclined position in which parts will not spill out of an open upper end, a segment of said rail being lowerable to carry one of said barrels at a downwardly outwardly inclined position in which parts will empty out of the lowered open end.

7. An apparatus for painting batches of parts, comprising:

(a) a frame having an annular rail;

(b) a horizontal turntable rotatably mounted on said frame and concentrically surrounded by said annular rail, said annular rail having a top surface above the level of said turntable;

(c) a plurality of barrels angularly spaced around said turntable for receiving batches of parts therein and having shafts, respectively, journalled in bearings on said turntable, a portion of each of said shafts rollingly riding on said rail such that said shaft portions and said barrels are inclined upwardly and outwardly with respect to said turntable;

(d) first drive means on said frame for intermittently rotating said turntable to angularly spaced first, second and third stations;

(e) second drive means on said frame for rotating said barrels in said angularly spaced stations; and (f) said angularly spaced stations being disposed on a portion of said frame which extends around said turntable, said first, second and third stations including a paint spray nozzle, a hot-air blower, and a cool-air blower, respectively, directed toward said barrels.

8. An apparatus according to claim 7, said annular rail including a segmental portion located at said third station and displaceable for moving one of said barrels at said third station outwardly and downwardly of said annular rail.

9. An apparatus according to claim 7, said shafts having driven gears, respectively, said second drive means comprising a pluriality of motors located respectively at said stations and a plurality of drive gears connected respectively to the motor shafts, each of said drive gears being in driving mesh with one of said driven gears when said barrels are held in said stations, respectively.

10. An apparatus according to claim 7, said barrels being made of wire mesh.

11. An apparatus according to claim 7, said frame including a plurality of support wings extending radially outwardly therefrom at said respective angularly spaced stations, including a plurality of box-like covers mounted respectively on said support wings for covering said barrels.

12. An apparatus according to claim 7, including means for separating any painted joined-together parts from each other after the cooling of the parts, and reversible conveyor means for selectably transporting the parts from one of said barrels to said separating means, or to discharge the parts from the apparatus.

13. An apparatus according to claim 12, said separating means comprising: an upright framework, a bucket vertically movable along said framework for carrying the parts, means on said framework for elevating said bucket, passage means on said framework for receiving the parts from the elevated bucket and guiding them, a blower duct mounted on said framework below said passage means for accelerating the parts downwardly therethrough, and a chute disposed below said blower duct for the passage therethrough of the parts, said chute having a wall in the path of movement of the parts, whereby the accelerated joined parts can impinge on said wall for being separated from each other in response to impact.

* * * * *